United States Patent [19]

Lorenz

[11] 4,060,967

[45] Dec. 6, 1977

[54] FALSE TWISTERS

[75] Inventor: Hellmut Lorenz, Remscheid, Germany

[73] Assignee: Barmag Barmer Maschinenfabrik Aktiengesellschaft, Remscheid-Lennep, Germany

[21] Appl. No.: 778,500

[22] Filed: Mar. 17, 1977

[30] Foreign Application Priority Data

Mar. 20, 1976 Germany ..... 2612023

[51] Int. Cl.[2] ..... D01H 7/92; D02G 1/06

[52] U.S. Cl. ..... 57/77.45; 57/77.4; 57/104

[58] Field of Search ..... 57/34 R, 77.3–77.45, 57/104

[56] References Cited

U.S. PATENT DOCUMENTS

| | | | |
|---|---|---|---|
| 3,488,676 | 1/1970 | Bieniok | 57/104 X |
| 3,788,056 | 1/1974 | Burri | 57/77.45 |
| 3,827,229 | 8/1974 | Bieniok | 57/104 X |
| 3,878,672 | 4/1975 | Köhler | 57/77.45 |
| 3,932,985 | 1/1976 | Naylor | 57/77.4 |

FOREIGN PATENT DOCUMENTS

| | | | |
|---|---|---|---|
| 2,123,643 | 11/1972 | Germany | 57/77.45 |
| 1,277,752 | 6/1972 | United Kingdom | 57/77.45 |

*Primary Examiner*—Donald Watkins

*Attorney, Agent, or Firm*—Keil, Thompson & Shurtleff

[57] ABSTRACT

A false twister for S or Z false twisting in which the false twist-imparting members, e.g., disks, and their shafts are rotatably driven about a fixed axis of rotation by alternately selectable drives in turn driven by tangential contact between an endless drive belt and a pair of whorls, the whorl assembly being swingably mounted on the twister assembly to provide drive contact and counterpressure contact by respective whorls.

11 Claims, 5 Drawing Figures

FALSE TWISTERS

There are a number of known devices for S or Z false twisting as desired. Thus, for example, in German published patent AS No. 11 65 805, an apparatus is described for the production of a crimped crepe twist, in which a small rotary tube is mounted on each end of a swinging arm lying in a plane perpendicular to the tangential plane of the drive belt. The swinging arm is positioned in such a way that one rotary tube is situated in front of and the other behind the tangential drive belt. It is thus possible to treat two threads simultaneously, one thread receiving an S-twist and the other a Z-twist. This apparatus has proved successful for this type of use.

If, however, this type of twist is not to be produced, whereby there is also eliminated the necessity of simultaneously producing in one working position two different false twists, this apparatus—if only one thread is to be false-twisted either in S or in Z direction—has the disadvantage that the thread can run in a straight line only in one false-twist tube. In the shifting over to the other false-twist type the thread is deflected from its running direction, in which case the deflection depends on the belt thickness and the radius of the rotary tube or of the whorl driving it.

A similar apparatus is known from Swiss Pat. No. 467,357. There, with the aid of a constructively very complicated arrangement, the friction false-twister is applied, in the first place, to the front side, and another time, to the back of the tangential belt. In this apparatus, too, the thread is thereby deflected from its running direction.

THE INVENTION

This invention provides aparatus for the S or Z false twisting at will, without the thread being deflected from its running direction in the shifting over from one twist type to the other. It has been found that the deflection in the case of some thread materials and denier values creates an undesirable quality sacrifice of the processed thread because through the deflection, there are negatively affected in particular the frictional relations between thread and friction disks.

According to the invention, the false twister device and its shafts rotate about a fixed axis while the whorls which drive them are swingably mounted by a swinging lever unit. It is necessary only to pivot the swinging lever unit in such a way that the whorl is applied once from the front and a second time from the back on its tangential drive belt, in order to achieve the desired twist direction. It thus becomes possible to mount the false twist system in fixed position, whereby no changes occur in the thread course in changing from S-twist to Z-twist and vice versa.

Preferably, the swinging lever unit has on its shaft or axle a wheel or gear which provides the drive connection between the false twist unit and its drive whorl shaft. The wheel rotates about the swinging axis of the swinging lever. Both the spacing of the wheel and the false twister and the spacing of the wheel and the whorl remain constant, so that the torque transmitting elements—ordinarily gear belts—do not change in their tension. Shifting over from Z to S false twists thus proceeds rapidly.

The further development of the invention comprises a support plate fastened to the machine frame, on which the false twist unit is detachably mounted and assures the advantage that the false twister together with the swinging lever can easily be removed from the texturizing machine without the other working stations being impaired or its being necessary to shut off the entire machine. Further, the swinging is thereby facilitated, since the shifting over of the swinging lever is not hampered by the tangential belt.

Through the separation of the swinging lever from the false twister, when both are fastened separately to the support plate, it is possible to dismantle only the false twister, without its being necessary to remove the swinging lever, or vice versa. This has proved advantageous especially when the friction disks have to be changed because of wear, which occurs considerably more often than a wearing of the whorl.

In order to avoid the necessity of providing between the wheel or gear and the false twister a gear belt or other mechanical connecting system, they are joined by a socket connection, e.g., a socket and head having serrations or matingly profiled shapes.

In the case of a socket connection between the central wheel or gear and the drive axle of the false twister there arises the danger that the assembly might be started without the socket connection being fully established. Thereby the socket connection would be ruined in a short time. In order to avoid this it is further proposed that there be coupled with the socket connection a safety device which assures that the whorl can be swung to its working position—i.e., lying against the tangential belt—only when the socket is fully seated on the head.

Preferably the swinging lever has two arms. On the end of each arm is a whorl, each of which is individually and readily brought into operative connection with the endless drive belt. Thereby, it is no longer necessary in changing from S to Z false twists or vice versa to lift the swinging lever off from the mounting plate in order to apply the whorl to the corresponding side to the tangential belt. It is only necessary to establish the corresponding operative connection between the whorl shaft and the central wheel gear.

A further feature of the apparatus is one wherein the axle or shaft on which the whorl-bearing swinging lever is mounted is positioned so that one of its two whorls acts as a belt-driven member while the other whorl acts as a counterpressure roller. This arrangement has the advantage that the steady engagements of the two whorls on the tangential belt hold it in a constant path always at the same distance from the machine front. If all the whorls on one side the machine lie on the same side against the tangential belt, and if there were no counterpressure members present, the belt would be deflected to one side by the whorls and change the frictional forces against the belt. Thereby arises the danger that not all the whorls are driven at the same speed by reason of the differing contact pressures.

For the swinging arm structures, it is advantageous if the two arms of the swinging lever are at 180° relative to each other and the swinging (pivot) axis lies in the plane of tangential drive belt. In this arrangement the pressure exerted from the belt-driven whorl and the counterpressure whorl on the tangential drive belt is equal, so that the belt travels linearly at a constant distance from the machine front.

If in the texturizing machine both false twist types are produced simultaneously, i.e., when one false twister is driven clockwise and the other counterclockwise, the problem of the belt-driven whorls being in engagement on only one side of the belt does not exist. Then it is advantageous to construct the device with the two arms of the swinging lever joined together by articulations at the pivot axis. This eliminates the need for the coupling belts between the whorls and the central wheel or gear.

It is also possible to change the whorls since this does not, as in the previously known false twisters, lead to changes of the thread course. This is especially advantageous when the texturizing machine is fitted with cooling rails. Through the simple change from a whorl of one diameter to a whorl of another diameter, the turning rate ratio (turning rate of the apparatus with respect to the linear thread velocity) can be adapted to particular machine-controlled tangential belt speeds.

THE ILLUSTRATED EMBODIMENT

In the following, a preferred embodiment of the invention is explained with the aid of drawings wherein.

Figure 1:
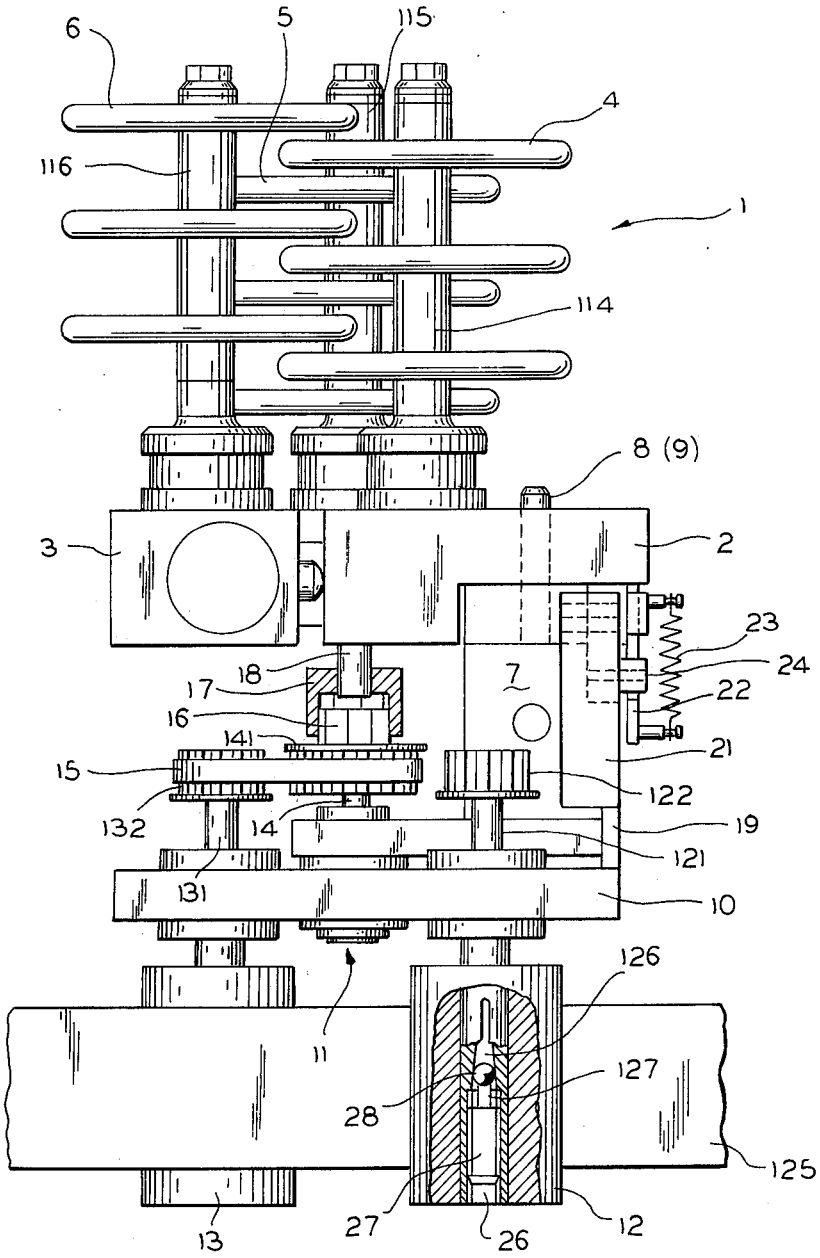
FIG. 1 represents a front elevation, partly in section, of the false twisting device.
Figure 2:
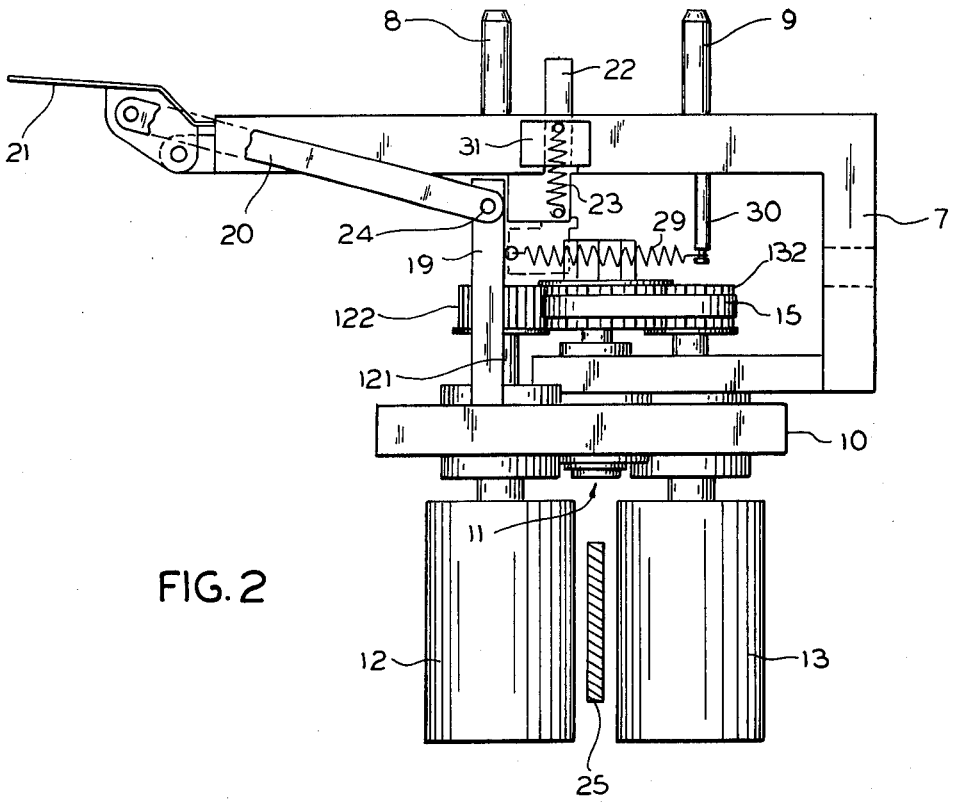
FIG. 2 is a side elevation thereof.

In FIG. 1 the friction twister assembly 1 comprises a stationary mounting member 2, a swingable mounting member 3, and the three rotatably drivable axles 114, 115 and 116 with the friction disk sets 4, 5 and 6. The friction assembly 1 is detachably mounted on the support plate 7 (FIG. 2) which is firmly secured to the machine frame. The member 2 has corresponding bores through which extend the pins 8 and 9 (FIG. 2). These pins are firmly mounted on the support plate 7.

Likewise on the support plate 7 there is rotatably journalled the swinging lever 10 which can pivot horizontally about the axis 11. The swinging lever 10 carries the two whorls 12 and 13. The whorl axles or shafts 121 and 131 bear on their upper free ends the gear belt pulleys or sprockets 122 and 132.

There is fastened to the freely rotatable axle or shaft 14, which is coaxial with the pivot axis 11 of the swinging lever 10, a gear belt pulley or sprocket 141, which can be driven by either gear belt pulley 122 or gear belt pulley 132 via a gear belt 15. The end of the axle or shaft 14 contiguous to the friction assembly 1 has a hexagon head 16. A mating, internally hexagonal socket 17, which is fixedly connected to the main drive axle 18 of the friction assembly 1, fits over the hexagon head 16 to provide a socket coupling assembly.

Figure 3:
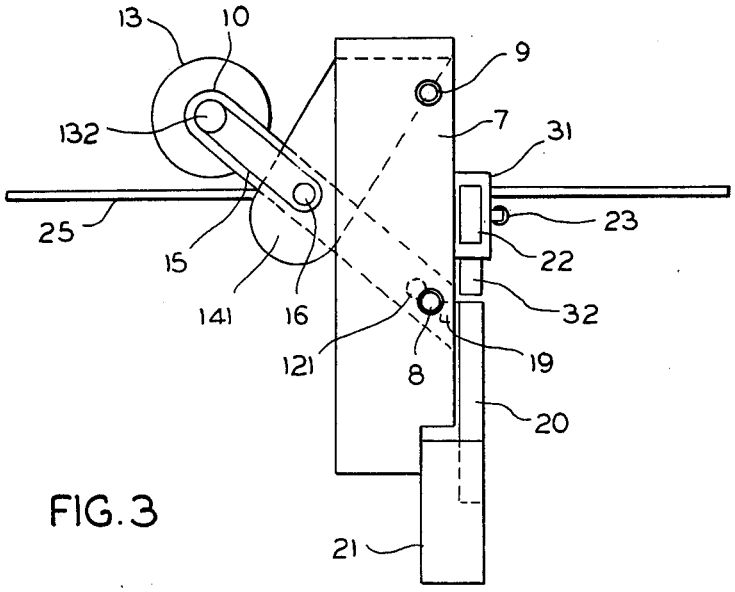
FIG. 3 is a top plan view of the apparatus of FIG. 2.

In FIGS. 2 and 3 the swinging and bolting mechanism for the swinging lever 10 is illustrated. On the other end of the swinging lever 10 in the vicinity of the whorl axle 121 there is welded in position a bar or rod 19, on the upper end of which a lever 20 is articulated. The front end of the lever is likewise articulately joined with the handle 21, which in turn is pivotally mounted on the support plate 7. A tension spring 29 is connected at its one end to the plate 7 via pin 30 and at its other end to the bar or rod 19. The lever 20 is fastened to the handle 21 in such a way that, in the rest position shown in FIG. 2, it remains in its position.

The safety lock arrangement consists of an L-plate 22 which is vertically slidable in the bracket 31 mounted on the plate 7. The L-plate is held in the upper, locking position (FIG. 2) by the spring 23. The shorter, horizontal leg of the L-plate 22 coacts, when the L-plate is in the illustrated locking position, with the contiguous end of the lever 20 to preclude pivoting of the lever 10, e.g., by aligned, contiguous, abutting edges on facing parts of the shorter leg and on the adjacent end of lever 20. When the L-plate 22 is pushed downwardly, the safety lock arrangement disengages.

The manner of functioning of the apparatus according to the invention is the following:

When a friction assembly 1 is placed on the apparatus represented in FIG. 2, then the stationary support plate 2 shifts the L-plate 22 downward against the action of the spring 23. Thereby the handle 21 can be tipped downward, whereby the swinging lever 10 is swung in such a way that the whorls 12 and 13 lie against the tangential drive belt 25. The amount of the contact pressure force between the whorls and the tangential belt is determined by the spring 29 which also assures that the whorls remain in frictional contact with the tangential belt. The tipping of the handle 21 can be carried out only if the L-plate 22 is completely depressed. Thereby it is assured that the socket 17 is seated securely over the hexagon head 16, so that the drive moment can be transmitted without play. The gear belt 15 is connected, according to the desired direction of false twist, with the whorl 12 or 13.

For changing from one type of false twist to the other, first the handle 21 is tipped upward. This pivots the lever 10, and the two whorls 12 and 13 move out of contact with the tangential belt 25. After the assembly 1 has stopped rotating, it is lifted from the mounting plate 7. Through the lifting off of the assembly 1, the L-plate 22 is raised by the spring 23 into the locking position, so that the handle 21 can no longer be tipped.

Thereby the two whorls assuredly are prevented from moving into contact with the tangential drive belt 25. Thereby the wear on the socket coupling 16, 17 is precluded. Thereupon, the gear belt 15 is changed from the gear belt pulley 132 onto the gear belt pulley 122, whereby the central gear belt pulley 141 is driven in reverse direction of turning. The friction assembly 1 is reset in position. The socket 17 again passes over the hexagon head 16, the L-plate 22 of the security arrangement is brought into the unsecured position, and the handle 21 can again be tilted downward so that the lever 10 can pivot and the whorls 12 and 13 again come in frictional contact with the tangential drive belt 25.

In FIG. 1 there is shown how the whorls 12 and 13 can be fastened removably and changeably to their axles. The whorl axles 121, 131 are slitted in the zone of the whorls. These axles have an axial bore 26 which is provided in the lower region with a thread for the reception of the setscrew 27. Above the thread the bore is tapered toward the upper end of the slit.

When the setscrew 27 is threaded into bore 26, the cylindrical tip 127 of the setscrew engages the ball 28. As the latter is pushed into the tapered portion 126 of the bore, the split end of the axle is spread. Thereby the whorl is secured on the axle. By partial unscrewing of the setscrew 27, the spreading of the whorl axle is cancelled, and the whorl can be removed and changed for another with a different diameter. Thereby it is possible, with constant tangential belt speed, to change the turning rate of the friction assembly. This change of the whorl diameter has no influence there on the thread course, since the friction assembly is not influenced by it.

For better understanding, the whorl 12 and gear belt pulley 122 are not shown in FIG. 3. The gear belt 15 runs from gear belt pulley 132 to gear belt pulley 141. Here, the swinging lever 10 is shown in its changing position, i.e., whorls 12 and 13 are not contacting the tangential belt 25. This arrangement does not correspond to that one as shown in FIG. 1, because in FIG. 1 the two whorls 12 and 13 are in contact with the tangential belt 25, so that handle 21 is turned in downward direction. In FIS. 2 and 3, however, the lever 21 is turned in upward direction. Based on the fact that no false twist assembly 1 is mounted on the apparatus, the L-plate 22 is flexibly linked on the same level as the pivot 24 at the rod 19 with lever 20.

If, however, based on the arrangement as per FIGS. 2 and 3, the handle 21 would be tilted on downward direction, lever 20 would push against the horizontal leg 32 of the L-plate 22 on the same level as the pivot 24. By doing this, the tilting movement of handle 21 is stopped. The rod 19 is arranged beside the L-plate 22, so that its movement is not disturbed.

If, however, a false twist assembly is mounted as in FIG. 1, the stationary mounting member 2 of the false twist assembly pushes the L-plate in downward direction, so that its horizontal leg 32 comes below the pivot 24 and the lever 20. In this way, the handle 21 can be tilted, because the horizontal leg 32 is no longer hindering the movement of the lever 20, so that the rod 19 can turn around the pivot axis 11. This is shown in FIG. 1, in which the position of the horizontal leg 32 is clearly shown. Based on its pivot with lever 20, the handle 21 in the shown position cannot automatically be drawn from tension spring 29.

Figure 4:
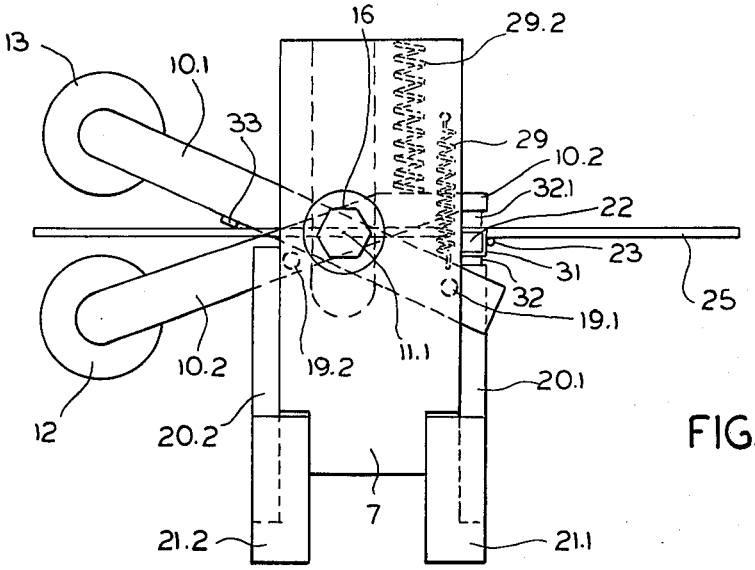
FIG. 4 is a top plan view of another embodiment of the invention.
Figure 5:
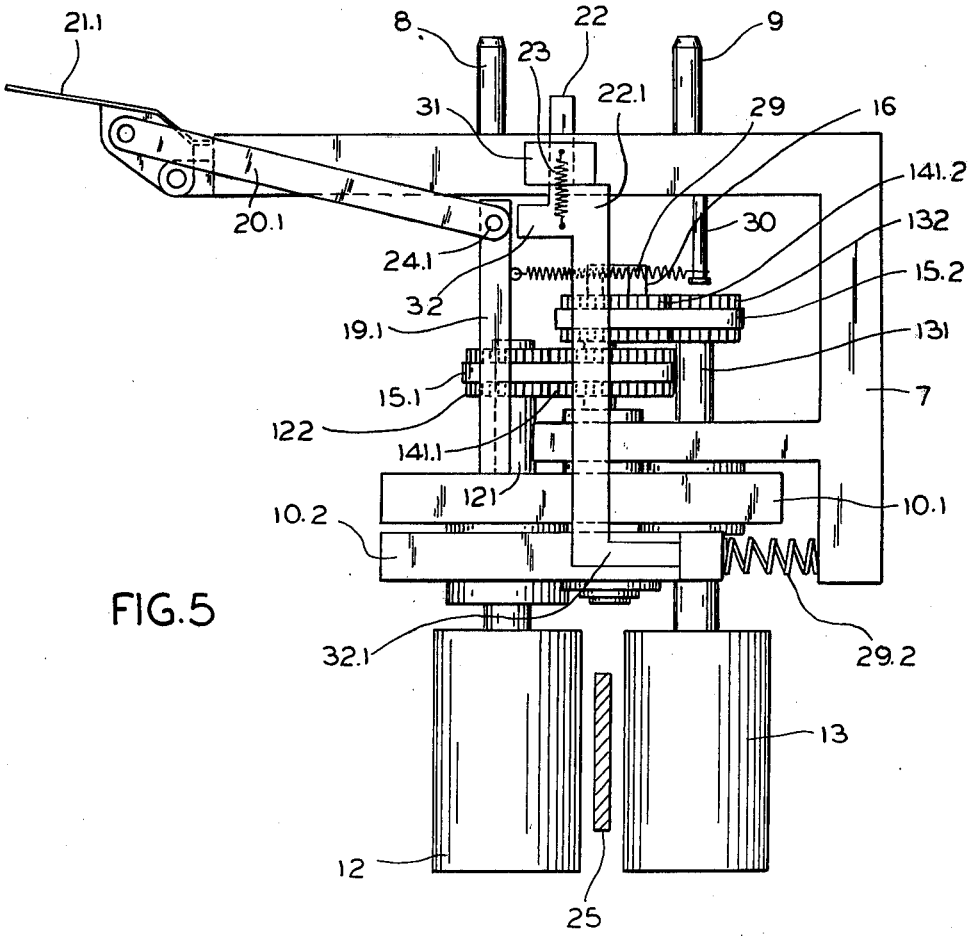
FIG. 5 is a side elevation of the embodiment of FIG. 4.

FIG. 4 represents a topview of the support plate 7, whereas FIG. 5 is a side elevation, whereby the direction of view is identical with those of FIGS. 2 and 3. In order to improve the clearness of FIG. 4, gear belt pulleys 122 and 132, the gear belt pulley 141 and gear belt 15 are not shown. Their arrangement can be seen from FIG. 5. The swinging lever 10, as shown, is separated into two arms 10.1 and 10.2. The arms are revolvingly mounted one upon another on the pivot axis 11.1. It is necessary to make the whorl axles 121 and 131 of a different length, in order to ensure that whorls 12 and 13 are contacting the tangential belt 25 at the same lever. The operation of the two arms is effected, as already described for FIGS. 1–3, by means of handles 21.1 and 21.2, lever 20.1 and 20.2 and rods 19.1 and 19.2.

The locking of the arms 10.1 nd 10.2, i.e., the securing against unintended sticking of a whorl to the tangential belt 25, in the absence of a false twist assembly, here also is effected via L-plate 22.1, which is equipped with two L-plates because of the two arms, having a different length (FIG. 5). The L-plate 22.1 in its upper part is identical with L-plate 23 of FIG. 2. However, it has a prolongation with a second L-lever 32.1, which is directed against the rear part of arm 10.2. The second arm 10.2 also is connected to a tension spring 29.2. In contrast with the layout of support plate 7 in FIGS. 1–3, here it is necessary that a mutual locking of the arms is ensured during the operation of the apparatus. This is necessary because of the fact that both whorls 12 and 13 are constantly connected with the gear belt drive via the tangential belts 15.1 and 15.2 (FIG. 5). For this reason no shifting of the only gear belt as in FIG. 1 is necessary.

This locking is shown in FIG. 4 and consists of a stop plate 33, which is fastened at the arm 10.1. The stop plate is laid out in such a way that it is pushing against the arm 10.2 when the whorl 13 is in working engagement with the tangential belt 25, so that whorl 12 cannot be engaged. In the same way, the arm 10.1 pushes with the stop plate 33 against the arm 10.2 when the whorl 12 is engaged. By this fact, the engaging of arm 10.1 is avoided.

It is thought that the invention and its numerous attendant advantages will be fully understood from the foregoing description, and it is obvious that numerous changes may be made in the form, construction and arrangement of the several parts without departing from the spirit of scope of the invention, or sacrificing any of its attendant advantages, the forms herein disclosed being preferred embodiments for the purpose of illustrating the invention.

The invention is hereby claimed as follows:

1. A false twister comprising a false twister unit including rotating means for applying a false twist to threads running therethrough, a whorl having a vertical axis of rotation, an endless drive belt adapted to drive said whorl when the latter is in tangential contact with said belt, and characterized by said whorl being rotatably journalled on a swinging member pivotally mounted on a vertical shaft and adapted to pivot about a vertical axis, thereby shifting said whorl into and out of tangential contact with said belt, said rotating means having fixed, constant axes of rotation providing the same path for the thread running therethrough in both S-twist and Z-twist, and rotational drive connection means operatively connecting said whorl and said rotating means.

2. A false twister as claimed in claim 1, said drive connection means embodying a drive wheel or gear rotatably mounted on said vertical shaft, first means operatively connecting said drive wheel or gear with said rotating means, and second means operatively connecting said drive wheel or gear with said whorl.

3. A false twister as claimed in claim 1, and further characterized by a support member attached to a frame, and means detachably mounting said false twister unit on said support member.

4. A false twister as claimed in claim 3, and further characterized by means rotatably mounting said swinging member on said support member for pivotal movement about said vertical axis.

5. A false twister as claimed in claim 4, and further characterized by said first means embodying a socket connection between said drive wheel or gear and a vertical drive shaft operatively connected to said rotating means.

6. A false twister as claimed in claim 5, and further characterized by means having a first position for locking said swinging member against pivotal movement and movable to a second position upon engagement of said socket connection to release said swinging member and allow it to pivot about said vertical axis.

7. A false twister as claimed in claim 1, and further characterized by said swinging member being a centrally pivoted, swinging lever having two of said whorls respectively mounted on opposite ends of said lever.

8. A false twister as claimed in claim 1, and further characterized by said swinging member being a centrally pivoted, swinging lever having two of said whorls respectively mounted on opposite ends of said lever, one whorl being on one side of said endless drive belt and the other whorl being on the opposite side of said belt.

9. A false twister as claimed in claim 8, and further characterized by said lever having whorl bearing arms extending in opposite directions from the central pivot of said lever.

10. A false twister as claimed in claim 7, and further characterized by said lever having whorl bearing arms horizontally swingingly articulated relative to each other at the whorl remote ends of said arms.

11. A false twister as claimed in claim 1, and further characterized by means releasably mounting said whorl on a vertical shaft whereby one whorl may be replaced by another whorl.

* * * * *